US005908357A

United States Patent [19]

Hsieh

[11] Patent Number: 5,908,357

[45] Date of Patent: Jun. 1, 1999

[54] GOLF CLUB HEAD WITH A SHOCK ABSORBING ARRANGEMENT

[76] Inventor: Chih-Ching Hsieh, No. 64, Lane 107, Liang Tsun Rd., Fong Yuan City, Taichung Hsien, Taiwan

[21] Appl. No.: 08/961,269

[22] Filed: Oct. 30, 1997

[51] Int. Cl.[6] ..... A63B 53/04

[52] U.S. Cl. ..... 473/327; 473/346

[58] Field of Search ..... 473/324, 327, 473/328, 332, 345, 346

[56] References Cited

U.S. PATENT DOCUMENTS

| | | | |
|---|---|---|---|
| 3,468,544 | 9/1969 | Antonious | 473/327 |
| 3,794,328 | 2/1974 | Gordon | 473/327 |
| 4,809,982 | 3/1989 | Kobayashi | 473/327 |
| 5,054,784 | 10/1991 | Collins | 473/327 |
| 5,158,296 | 10/1992 | Lee | 473/327 |
| 5,397,126 | 3/1995 | Allen . | |
| 5,524,890 | 6/1996 | Kim | 473/327 |
| 5,529,303 | 6/1996 | Chen | 473/327 |
| 5,681,227 | 10/1997 | Sayrizi . | |
| 5,711,722 | 1/1998 | Miyajima . | |

*Primary Examiner*—Sebastiano Passaniti
*Attorney, Agent, or Firm*—Varndell Legal Group

[57] ABSTRACT

A golf club head having a plurality of pores spaced along scoring lines of a face in front of a recessed top chamber thereof, and a circular through hole at the center of a back wall thereof behind the recessed top chamber for guiding air out of the recessed top chamber when striking the ball.

2 Claims, 3 Drawing Sheets

GOLF CLUB HEAD WITH A SHOCK ABSORBING ARRANGEMENT

BACKGROUND AND SUMMARY OF THE INVENTION

The present invention relates to a golf club heads, and more particularly to such a golf club head which has means to lessen shocks when striking the ball.

The game of golf has become more and more popularly accepted by adult people. When playing the golf, different numbers of golf clubs may be used in different conditions. Conventional golf clubs are commonly made of wood. In recent years, a variety of materials including iron, carbon fibers, titanium, etc., have been developed for use in making club heads for golf clubs. In order to diminish material consumption and to reduce the weight, a club head for golf clubs is made having a recessed top chamber. However, a club head of this design con not efficiently absorb or lessen shocks when striking the ball.

It is one object of the present invention to provide a golf club head which effectively lessens shocks when striking the ball. It is another object of the present invention to provide a golf club head which produces a sound when striking the ball. To achieve these and other objects of the present invention, there is provided a golf club head which comprises a recessed top chamber, a face disposed at a front side of the recessed top chamber for striking the ball, the face having a plurality of scoring lines at an outer side, and a back wall disposed at a back side of the recessed top chamber opposite to the face, wherein a plurality of pores are provided at the face along the scoring lines and disposed in communication with the recessed top chamber; a circular through hole is provided at the center of the back wall and disposed in communication with the recessed top chamber for guiding air out of the recessed top chamber, the circular through hole having a diameter about within ⅙ to ¼ of the width of the face.

DETAILED DESCRIPTION OF THE PREFERRED EMBODIMENT

Figure 1:
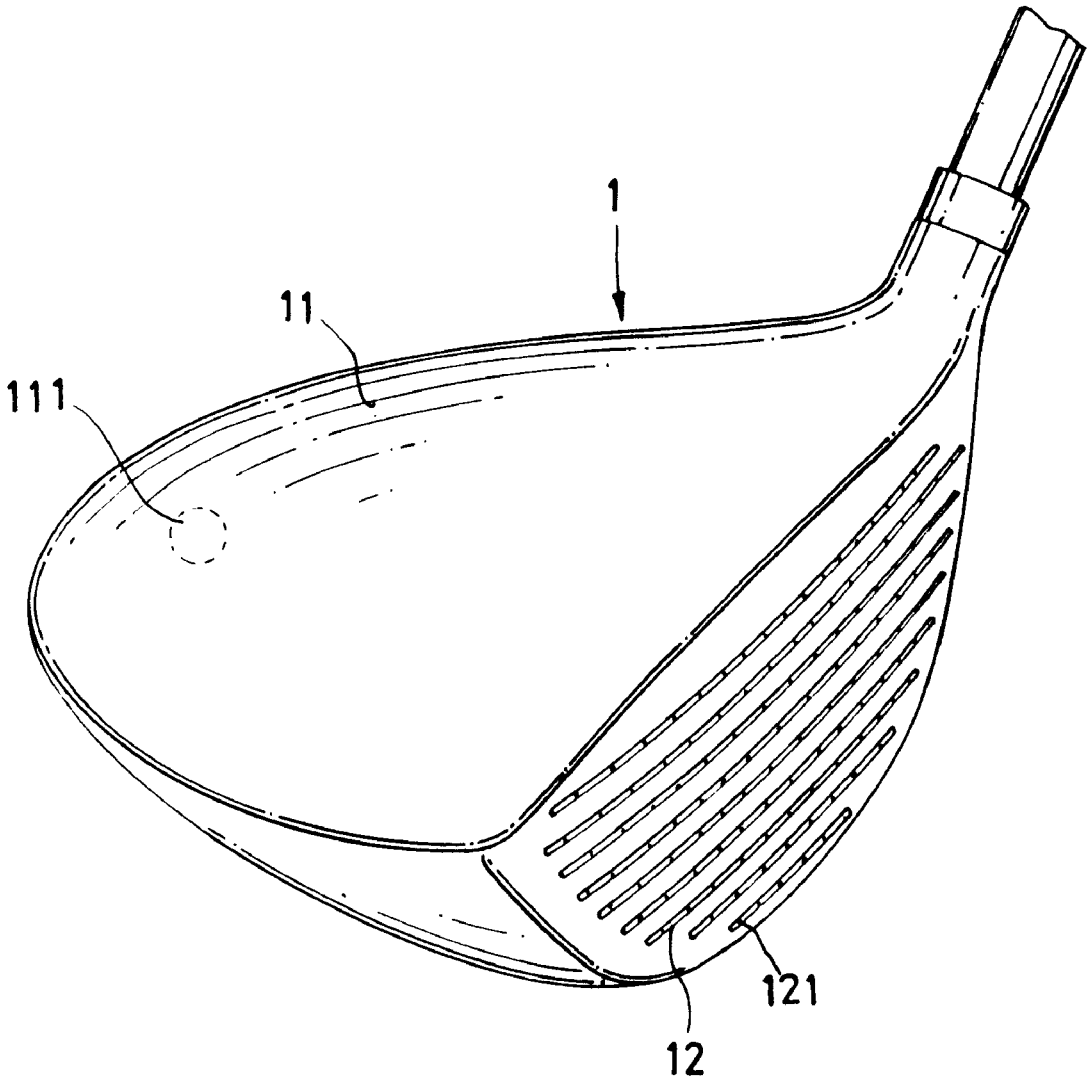
FIG. 1 is a perspective view of a golf club head according to thepresent invention.
Figure 2:
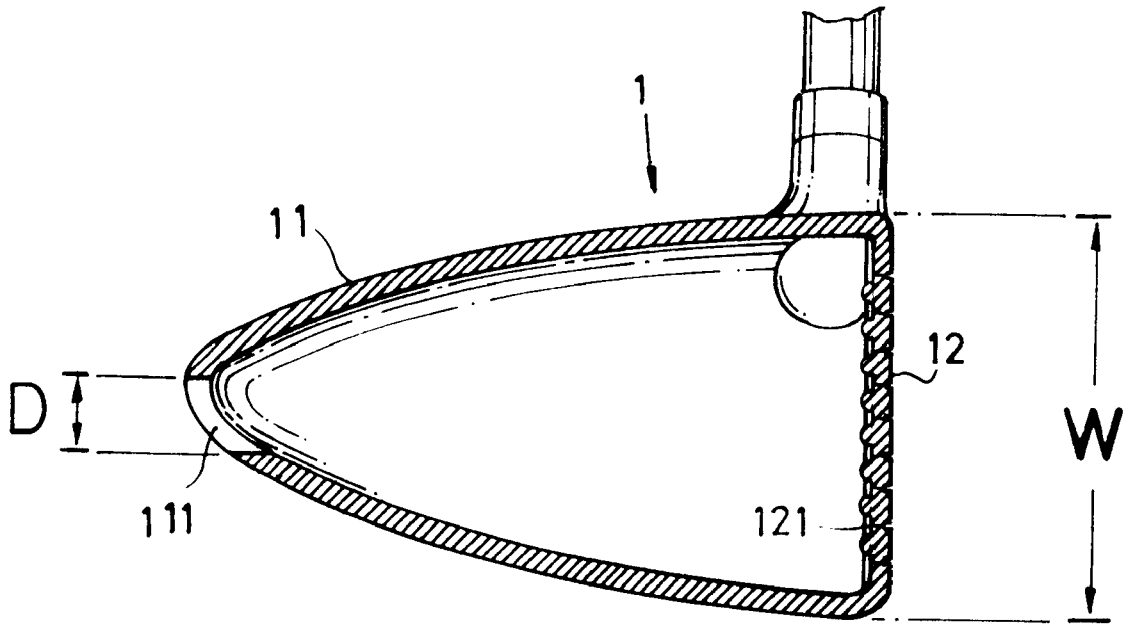
FIG. 2 is a sectional view of the golf club head shown in FIG. 1.

Referring to FIGS. 1 and 2, a golf club head 1 is shown comprising a recessed top chamber 11, and a face 12 at a front side of the recessed top chamber 11. A plurality of pores 121 are provided at the face 12 on its scoring lines, and disposed in communication with the recessed top chamber 11. A circular through hole 111 is provided at the center of the rear side of the club head 1, and disposed in communication with the recessed top chamber 11. When striking the ball, air is allowed to pass through the pores 121 into the recessed top chamber 11, and then to pass out of the recessed top chamber 11 through the circular through hole 111. When a current of air passing through the circular through hole 111, a sound is produced. The diameter D of the circular through hole 111 is preferably set within about ⅙ to ¼ of the width W of the face 12.

Figure 3:
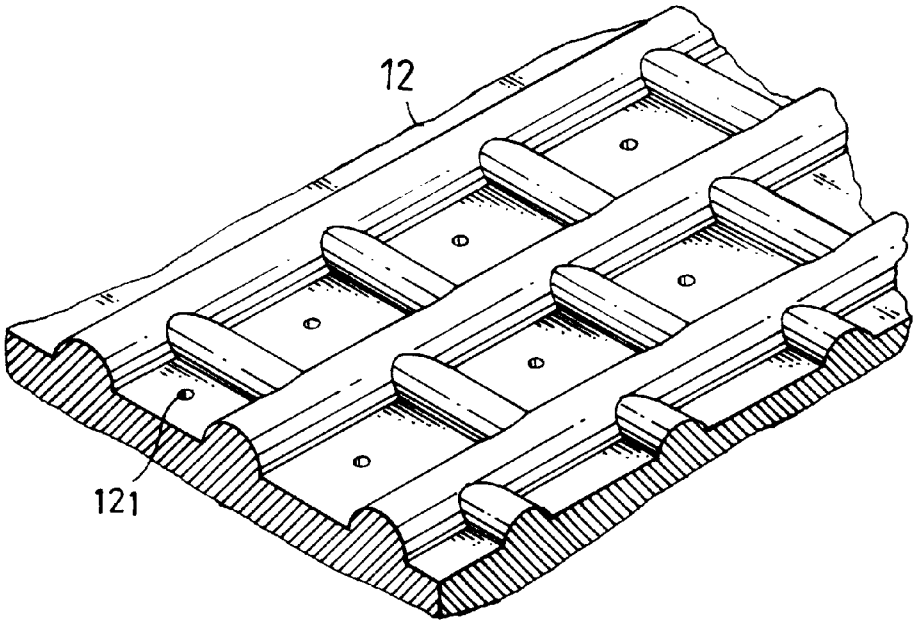
FIG. 3 is a back side view in an enlarged scale of a part of the face of the golf club head shown in FIG. 1.
Figure 4:
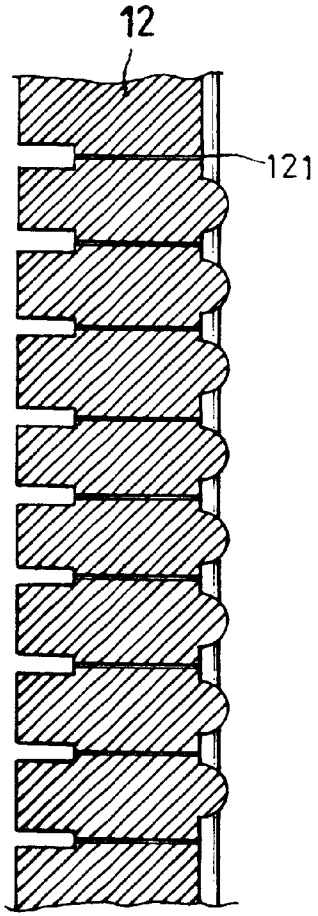
FIG. 4 is a sectional view in an enlarged scale of the face of the golf club head shown in FIG. 1.

Referring to FIGS. 3 and 4, longitudinal and transverse reinforcing ribs are integral with the back side wall of the face 12 outside the pores 121 to reinforce the structural strength of the face 12.

I claim:

1. A golf club head comprising a recessed top chamber, a face disposed at a front side of said recessed top chamber for striking a golf ball, and a back wall disposed at a backside of said recessed top chamber opposite to said face, said face including a plurality of scoring lines at an outer side thereof, and further comprising:

shock absorbing means for reducing shock when the golf club head strikes a golf ball, said shock absorbing means including a plurality of pores provided in said face along said scoring lines and communicating with said recessed top chamber, and a circular hole provided at a center of said back wall and communicating with said recessed top chamber, said hole having a diameter about between ⅙ to ¼ of a width of said face, and reinforcing means for reinforcing the structural strength of said face including longitudinal and transverse ribs integrally formed with a backside of said face, wherein said pores are arranged between said longitudinal ribs and transverse ribs.

2. The golf club head according to claim 1, wherein said longitudinal ribs extend across said backside of said face, and said transverse ribs are arranged between said longitudinal ribs in a staggered pattern.

* * * * *